US006405972B1

(12) United States Patent
Wakam

(10) Patent No.: US 6,405,972 B1
(45) **Date of Patent: *Jun. 18, 2002**

(54) TOILET PAPER ROLL STORAGE AND DISPENSER

(76) Inventor: Bonaventure J. Wakam, 7404 Nixon Ct., Ventura, CA (US) 93003

( * ) Notice: Subject to any disclaimer, the term of this patent is extended or adjusted under 35 U.S.C. 154(b) by 0 days.

This patent is subject to a terminal disclaimer.

(21) Appl. No.: 09/377,324

(22) Filed: Aug. 19, 1999

Related U.S. Application Data

(63) Continuation-in-part of application No. 29/105,107, filed on May 18, 1999, now Pat. No. Des. 418,705.

(51) Int. Cl.[7] ..... B65H 16/04
(52) U.S. Cl. ..... 242/597.7; D6/523
(58) Field of Search ..... 242/597.7, 588.2, 242/588.6; D6/523, 522

(56) References Cited

U.S. PATENT DOCUMENTS

| | | | | | |
|---|---|---|---|---|---|
| 3,843,071 | A | * | 10/1974 | Graham | 242/597.7 |
| 4,177,958 | A | * | 12/1979 | Poole | 242/597.7 |
| 4,314,679 | A | * | 2/1982 | Paul et al. | |
| D327,798 | S | * | 7/1992 | Addison et al. | D6/523 |
| D418,705 | S | * | 1/2000 | Wakam | D6/523 |

* cited by examiner

*Primary Examiner*—John Q. Nguyen
(74) *Attorney, Agent, or Firm*—Marvin E. Jacobs

(57) ABSTRACT

A toilet paper storage device which can be used for storing or dispensing rolls of toilet paper. The device has a cover and a base. The base can be positioned against a vertical wall and the cover can either be slidingly removed or pivotally displaced from the base in order to gain access to the interior of the device. The device can incorporate a raised flat panel which is formed in the sidewall of the cover. Because the flat panel is has a smaller diameter than the overall cover, the raised flat panel can be gripped with a single hand and facilitates ease of use by the elderly or a child.

11 Claims, 4 Drawing Sheets

TOILET PAPER ROLL STORAGE AND DISPENSER

CROSS-REFERENCE TO RELATED APPLICATION

This application is a continuation-in-part of ornamental design application Serial No. 29/105,107, filed May 18, 1999, now Des. 418,705 and is disclosed in Disclosure Document No. 444281, filed Sep. 14, 1998.

TECHNICAL FIELD

This application relate to a holder for the storage and/or dispensing of toilet paper rolls.

BACKGROUND OF THE INVENTION

Rolled toilet paper is marketed as a continuous sheet of soft absorbent paper divided into about 500 to 1500 panels by perforated tear lines. Toilet paper is usually dispensed by mounting the central cardboard tube on a cylindrical rod and pulling on the exposed panel to rotate the tube on the rod. The roll is finite.

When the toilet paper is exhausted, a fresh roll is needed. Most toilets and toilet paper dispensers are located remote from locations where fresh toilet paper rolls are stored such as cabinets under the sink or linen closets or other closets. In industrial and commercial restrooms, extra rolls are usually provided within the dispenser or by mounting a plurality of dispensers near the toilet. Some of these multiple roll. dispensers have complex mechanisms for storing the roll and translating it into place when the adjacent roll is exhausted.

| List of References | |
|---|---|
| Des. 201,099 | Brillante |
| Des. 310,759 | Breger |
| Des. 344,425 | Balanesi |
| 2,576,526 | Marchand |
| 2,974,839 | Batlas, et al. |
| 2,993,658 | Sweeney |
| 4,058,354 | Powaska |
| 4,177,958 | Poole |
| 4,199,078 | Ramirez |
| 4,314,679 | Paul, et al. |
| 4,607,809 | Sineni |
| 4,765,475 | Kaysserian |
| 4,775,109 | Tegg |
| 5,009,313 | Morand |
| 5,219,126 | Schutz |
| 5,743,397 | Traver |

STATEMENT OF THE PRIOR ART

Brillante discloses a cylindrical roll storage container with removal front panel and hinged top. Breger illustrates a rectangular toilet paper dispenser with top hinged front cover. Balanesi's cylindrical tissue dispenser and receptacle has an openable top cover lid. The recessed toilet tissue holder and dispenser disclosed by Marchand deploys outwardly when the cover is opened. Batlas, et al. teaches a rectangular paper towel dispenser with a latched and hinged 3-sided cover. Sweeney discloses a rectangular toilet paper dispenser with a bottom hinged front cover. The rectangular toilet roll storage container disclosed by Powaska has the rolls stored horizontally. Poole illustrates a cylindrical toilet paper pedestal dispenser for 3 rolls.

Ramirez's and Paul, et al.'s rectangular toilet tissue storage container have horizontal storage.

Sineni's cylindrical storage container hangs on a toilet tank and has vertical storage of 3 rolls. The rolls are dispensed through the top of the container.

Kaysserian discloses a rectangular holder dispenser for vertical storage of rolls. Tegg shows a side by side or stacked horizontal storage of rolls. Morand discloses a cylindrical container-dispenser storing one extra vertically positioned roll. Schutz shows a vertical container with curved front and flat rear panel for vertically stacking two rolls. Sheets are dispensed through a cone dispenser positioned in the bottom wall.

FIG. 8 of Traver shows a container for storing 2 vertical rolls side by side. There is a top lid for access to the rolls.

STATEMENT OF THE INVENTION

The toilet paper storage device of the present invention can be used either as a dispenser or alternatively, for storage device of a single or multiple rolls of toilet paper.

The storage device of the invention is designed to enclose and thereby protect one or more rolls of toilet paper from inadvertent contact with water or other liquids which could damage the paper's usefulness. The design of the holder of the invention makes it easier for children or the elderly to grip the cover and displace it in order to gain access to the toilet paper stored therein. Specifically, the design incorporates a gripping means which is preferably in the form of a raised front panel which is integral with the cover.

The storage device of the invention comprises two parts: a base and a cover.

The base comprises a bottom wall and a flat back wall integral with one another. The bottom has a periphery which is substantially three-quarters circular shape having a sufficient diameter for placement over the outside surface of a roll of toilet paper. The remaining portion of the bottom's periphery is linear. The back wall extends upward and away from the bottom wall.

The height of the back wall is designed to be slightly higher than the maximum number of toilet rolls which can be stacked inside the storage device. The back wall can be attached to the wall of a building or positioned along the side wall of a toilet tank. Attachment to a wall can be accomplished either by utilizing apertures located in the back wall in conjunction with screws secured to the wall of the building, or by use of an adhesive means such as adhesive tape or the like attached to the back wall of the device. If positioning along the side of a toilet tank is desired, either the adhesive means described above could be used or the base can further include a means to hang the device from the edge of the toilet tank.

The base further comprises a sidewall extending vertically away from or near the peripheral edge along the three-quarter circular shape of the bottom. The sidewall is defined as the portion of the base extending upwardly away from or near the peripheral edge of the bottom which is not considered the back. The sidewall is also joined or is integral with the back wall.

The upward extending sidewall is not required to be of uniform height. Preferably, the sidewall height is highest at its interfaces with the back. The top edge portions of the sidewall immediately adjacent to the back provide horizontal support surfaces for the cover when placed in position.

The portion of the sidewall distal from the back defines a raised front. The raised front is that portion of the sidewall which extends radially outward from the center of the bottom wall, relative to the adjacent portion of the sidewall. The raised front may have either a flat or convex surface.

The cover comprises a top and a sidewall. The contour of the cover sidewall is such that it can be slid over the sidewall base until the top rests upon the horizontal support surfaces described above.

To remove the cover from the base the raised front is used as a gripping means. Since the raised front is significantly less than the general diameter of the cover, it is much easier for children and the elderly to grip and control using only one hand. Alternatively, the gripping means could comprise a separate handle connected to the sidewall cover. However, this would make the device more expensive to manufacture.

Minor modifications can be utilized to make the storage device of the invention function as a dispenser or as a storage device.

If the device is to be used as a dispenser, it would also incorporate a cone extending with an upward taper from the center of the base bottom. In addition, there are two raised ribs on the lower front end of the base. These ribs both serve as reinforcement of the device and also to hold the cover in place to prevent/minimize side to side movement by the cover when toilet paper is being dispensed through the aperture. An aperture for displacement of sheets of toilet paper would be formed in the cover, preferably in the raised front portion of the cover sidewall. A single roll of toilet paper would be positioned about the cone, the free end of the toilet paper would be guided through the toilet paper aperture located on the cover and thereafter, the cover would be slid into position upon the base. When a replacement roll is desired, the user can grip the raised front with one hand, lift the cover, remove the core of the spent roll and replace it with a new roll. The cover is repositioned on the base after feeding the free end of the replace roll through the aperture on the cover.

If the device is to be used as storage only, it could be sized to store more than one roll of toilet paper and could also incorporate a pivoting means which would allow the cover to swing open in a direction away from the base back wall. The pivoting means may comprise a pair of prongs extending downward from the raised front of the cover, the tips of which contact two flat level surfaces on the raised front of the base sidewall. Additionally, a pair of guide tracks can be provided on the sidewall cover, each receiving a member which extends horizontally away from the base sidewall. The guide track can be a curved, arc-shaped aperture. The distal end of each member would extend through the corresponding arc-shaped aperture. The cover can then pivot into an open or closed position because of the prong tips in contact with the flat level surfaces.

To either add or remove rolls from the device, the user would grip the raised front and pull the cover outward. The cover would pivot about the prongs and could be pulled to the extent that the guide track arc-apertures would permit. To close, the cover is pushed toward the base back wall until the cover is again resting on the base.

It is to be understood, that a single sidewall joined to both sides of the base back wall is not a critical part of my invention and that alternatively, a pair of sidewalls can be utilized which do not join with one another.

Although the cover and base can be made of different material, preferably, both are made of the same material and most preferably, they are made of a lightweight plastic.

These and many other features and attendant advantages of the invention will become apparent as the invention becomes better understood by reference to the following detailed description when considered in conjunction with the accompanying drawings.

DETAILED DESCRIPTION OF THE INVENTION

Single Roll Storage Embodiment

Figure 1:
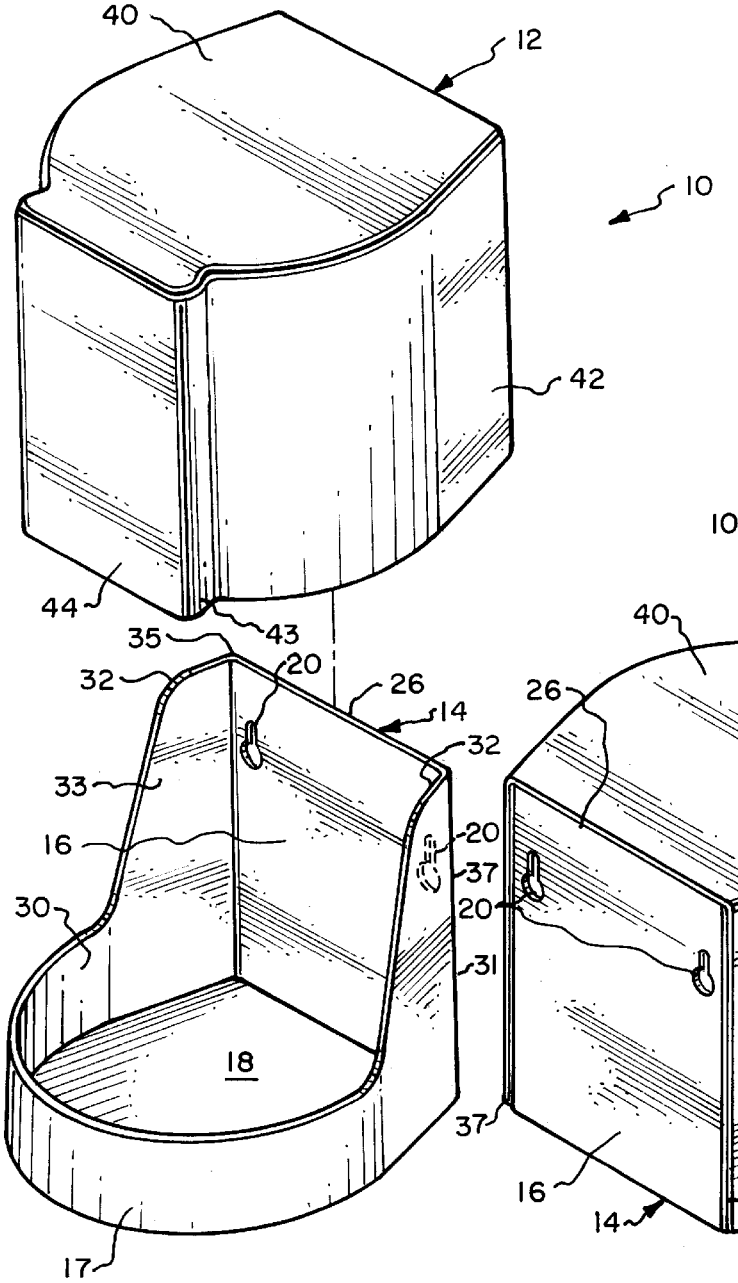
FIG. 1 is an exploded view of a first embodiment of a device for storing a single roll of toilet paper according to the invention.

Referring now to FIG. 1, a storage device 10 comprises a cover 12 and a base 14. Base 14 comprises a flat back wall 16 having a top edge, a bottom edge and a side edge 35, 37 which is integral with, or joined to a bottom wall 18. The bottom wall has a rear edge connected to the top edge of the back wall and having side edges connected to a curved front edge. Extending away from either side of the back wall 16 is a side wall 30 which also extends upward along a circular periphery portion of the bottom wall 18. A curved vertical front wall extends upwardly from the curved edge of the bottom wall and has vertical end edges and vertical rear edges.

The side wall 30 forms first straight portions 31, 33 which extend away from the side edges 35, 37 of the back wall 16 at substantially the same vertical height as the back wall 16 before sloping downward to a pair of vertical front edges which are joined to the vertical end edges of the front wall 17. This initial same vertical height form ledges 32 which extend away on either side of the back wall 16. The ledges 32 serve as a support for a cover 12 as will be discussed shortly. Apertures 20 are provided in the back wall 16 to be used in combination with screws or the like for attaching the base 14 to a wall structure.

The cover 12 is formed of a top wall 40 and a sidewall 42 which extends downward along the periphery of the top surface 40 except along the back wall 16 forming a rear opening 41. The portion of cover 12 not having a downward extending sidewall is the peripheral portion of top wall 40 which will be adjacent to the top edge 26 of the back wall 16 when the cover 12 is positioned upon the base 14.

Figure 2:
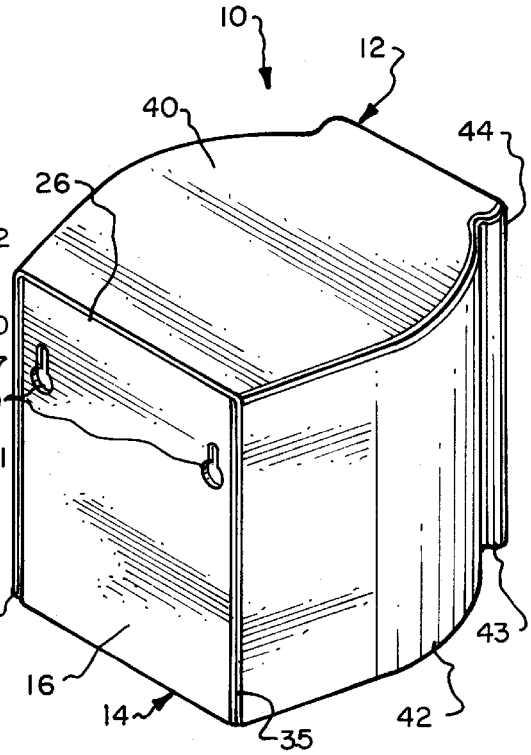
FIG. 2 is a rear perspective view of the first embodiment of the device shown in FIG. 1.

As can be seen in FIG. 2, the contour of cover 12 is such that the downward extending sidewall is continuous and the same cross section as the bottom wall 18 of the base 14 except that the interior circumference of the wall of the cover is slightly larger than the exterior circumference of the side wall of the base. The cover 12 can be slid over the sidewall 30 of the base 14 until the facing surface of the top wall 40 rests upon the ledges 32, described above.

Most importantly, the middle portion of the sidewall 42 defines a raised front 44 having side indentations 43 which provides a means to grip the cover 12 with a single hand.

Single Roll Dispenser Embodiment

Figure 3:
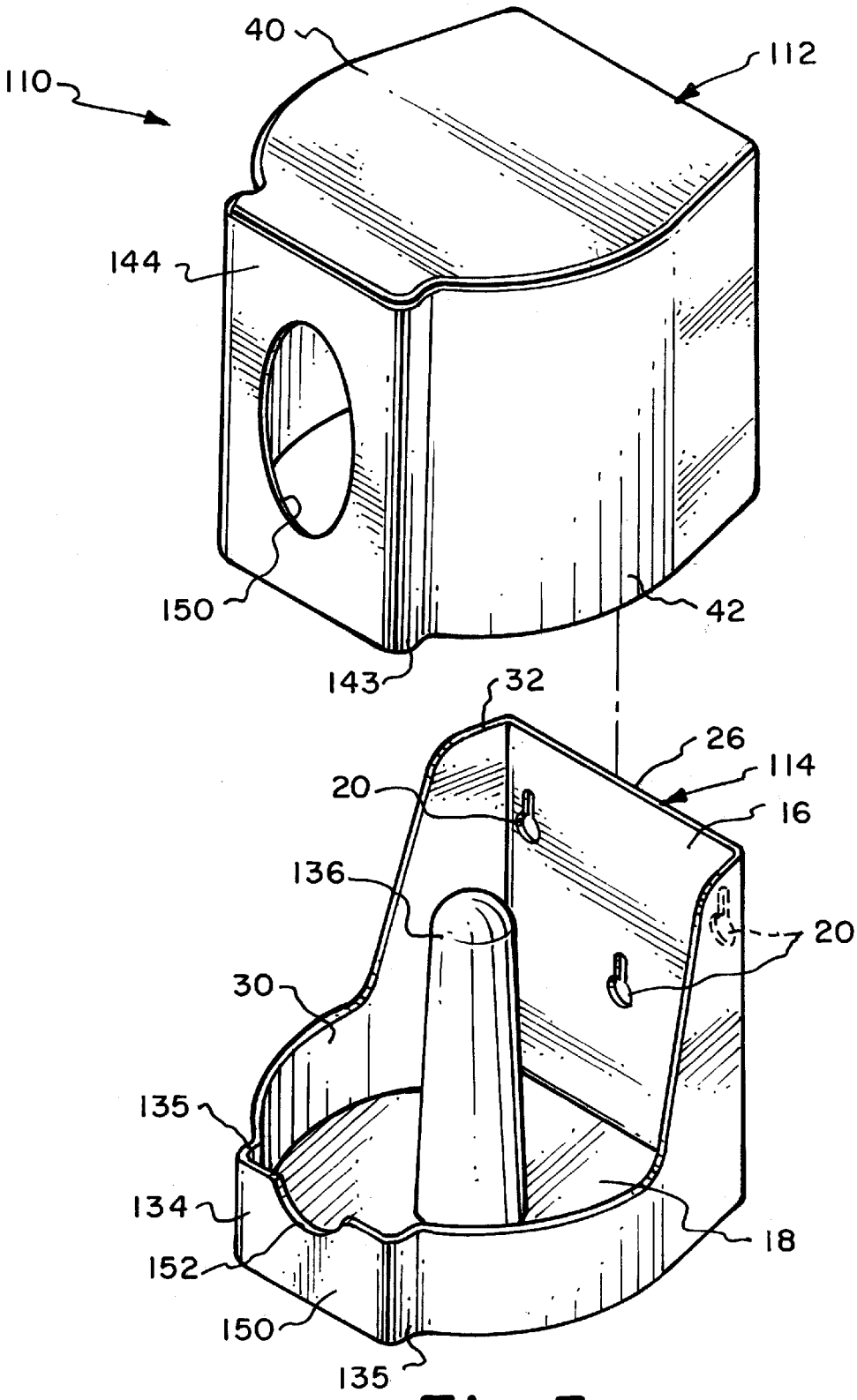
FIG. 3 is an exploded view of a second embodiment of the invention for dispensing a single roll of toilet paper.

As illustrated in FIG. 3 the storage device 110 comprises a cover 112 and a base 114. The storage device 110 further includes a tapered cone 136 which extends vertically upward from the center of bottom wall 18. The tapered cone 136 is used to properly and rotatably position a roll of toilet paper. Also, an aperture 150 is provided in the raised front 144 of the cover 112 for dispensing sheets of toilet paper therethrough.

The base 114 preferably includes a raised front panel displaced a short distance forward of the curved front wall of the base and connected to the front wall by a set of vertical panels 134 with side ridges 135 having the slightly smaller external dimensions than the internal of the raised panel 144 on the cover 112. When cover 112 is seated on the base 114, the indentation 143 on the raised panel 144 of the cover will slide over the side ridges 136 on the raised panel 134 on the base. The raised panel 134 with ridges will strengthen the base 114, will act as a guide for installation of the cover 112 and will prevent cocking, rotation or side to side movement of the cover 112 with respect to the base 114. The front wall 150 can be provided with a semi circular cut out 152 matching the contour of the oval aperture 150 in the raised panel 144 on the cover 112.

Hinge Storage Embodiment

Figure 4:
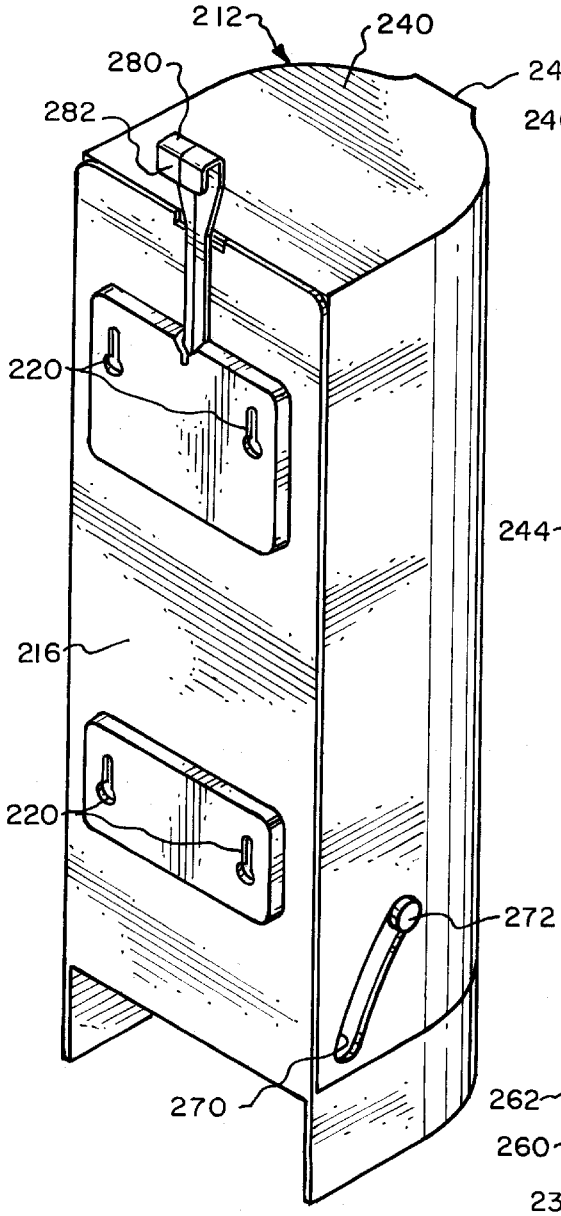
FIG. 4 is a rear perspective view of the third embodiment of the invention for storing multiple rolls of toilet paper incorporating a hanging means in the closed position.
Figure 5:
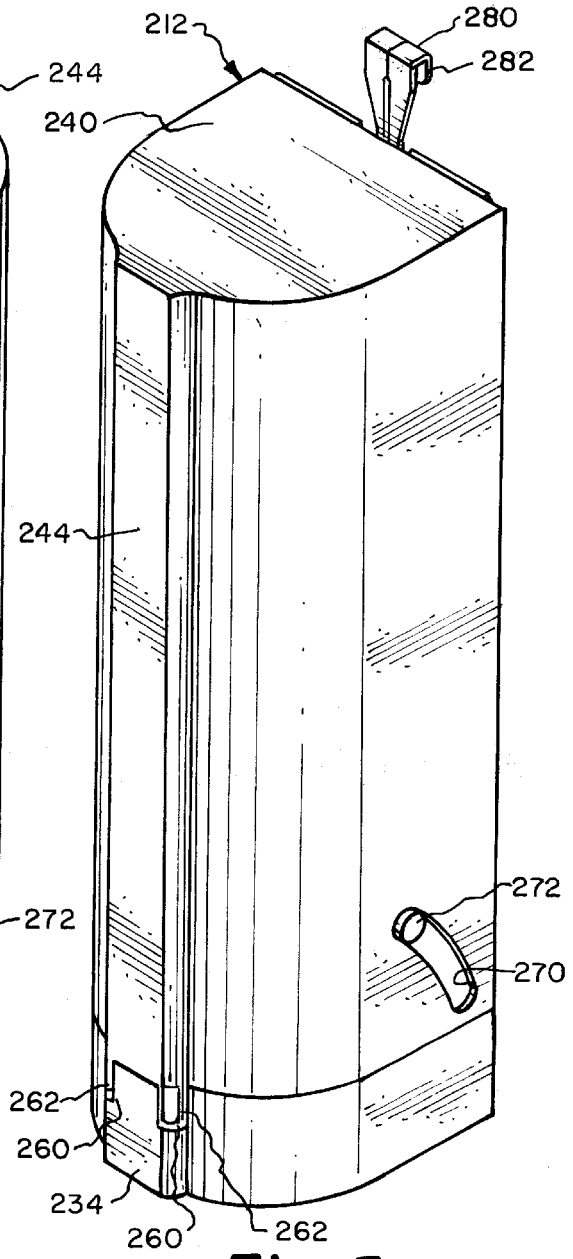
FIG. 5 is a front perspective view of the multiple storage embodiment incorporating a hanging means in the closed position.
Figure 6:
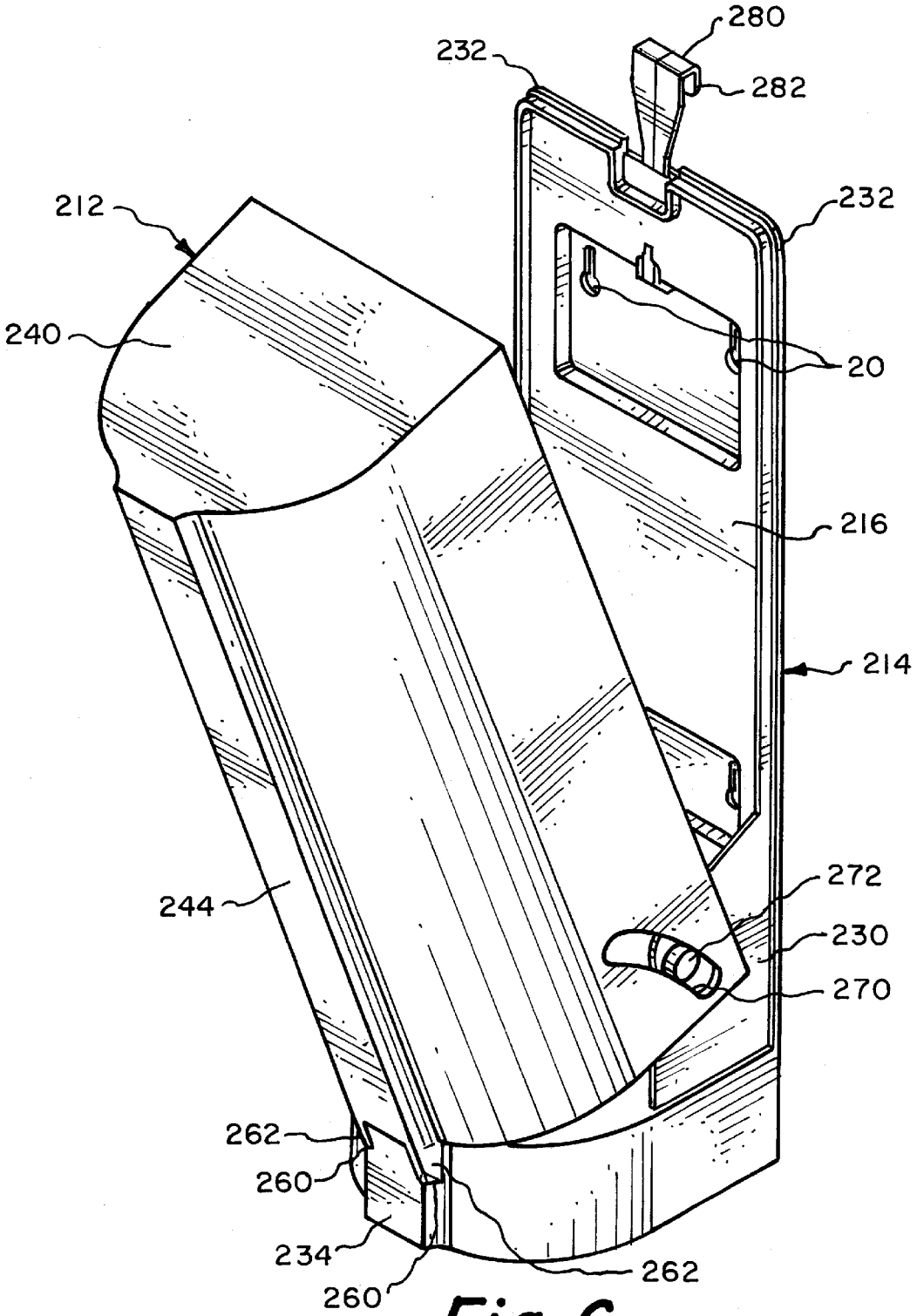
FIG. 6 is a front perspective view of the multiple storage embodiment incorporating a hanging means in the open position.

As shown in FIG. 4, FIG. 5 and FIG. 6, a multiple roll storage embodiment utilizes a pair of prongs 262 which act as a hinge to pivot the top portion of the cover 212 away from a back wall 216. In addition, a guide track 270 having a track member 272 which extends from sidewall 230 is provided to control the displacement of the cover 212 from the back wall 216.

In this embodiment, a base 214 has a raised front 234 which has a pair of flat surfaces 260 for receiving a pair of prongs 262. The flat surfaces 260 extend downward from the raised front 244 of the cover 212. The tips of both prongs 262 are in contact with the flat surfaces 260 and serve as a means to pivot the cover 212 away from the back wall 216 when a user desires to add or remove contents from the device.

The prongs 262 in contact with the flat surfaces 260 and the guide track provides support for the cover 212 upon the base 214. It is, therefore not necessary to have the same degree of sidewall support as for the previously described embodiments. However, ledges 232 are present to prevent cover 212 from pivoting into an open position.

As with the previously described embodiments, in order to gain access to the interior, a user grips raised front portion 244. Because of the pivoting means, the user should grip close to the top wall 240 in order to maximize the pivoting usefulness. As the user pulls the cover 212 away from the back wall 216, the cover 212 pivots on the prongs 262. The extent to which cover 212 will pivot is limited by the guide track 270 and the track member 272. The pivoting means disclosed is only for illustrative purposes and other pivoting means embodiments which will allow the cover to be displaced away from the back wall are equally suitable for use.

As illustrated in FIG. 4, FIG. 5 and FIG. 6, a hook member 280 extends from the top of the back wall 216. The hook member 280 has a trough 282 which is used to attach the device to a toilet tank by sliding the trough 282 over an edge portion of the toilet tank. The toilet tank cover can then be place on top of the toilet tank in the normal manner. A similar hook member can also be used as part of the single storage or dispenser embodiments.

Other modifications and variations are possible in light of the above teachings. Therefore, it is to be understood that within the scope of the appended claims, the invention may be practiced otherwise than as specifically described.

What is claimed is:

1. A toilet paper roll storage device comprising in combination:

a base comprising a flat back wall having a top edge, a bottom edge, a side edge;

a bottom wall having a rear edge connected to the bottom edge of the back wall and having side edges connected to a curved front edge, a curved front wall having a height substantially less than the height of the back wall and having vertical end edges, a pair of side walls diverging from the back wall each having a rear edge each connected to one of the side edges of the back wall and each side wall having a top ledge and extending forward from the back wall and having vertical front edges joined to the end edges of the front wall;

a cover having a curved front wall, top wall and full side walls slightly wider than said back wall of said base and side walls which wall cover is slidingly received on said base.

2. The device according to claim 1 wherein the top wall of the cover rests on the top ledges of the side walls of the base.

3. The device according to claim 1 in which the curved front wall of the cover includes a flat front panel displaced a short distance forward of the front wall and indented wall members connecting the panel to the front wall of the cover capable of being gripped by the fingers of the user.

4. The device according to claim 3 in which the bottom wall of the base further includes a vertical post for rotatably receiving a roll of toilet paper.

5. The device according to claim 3 in which the flat panel includes a wide oval aperture for dispensing sheets of toilet paper.

6. The device according to claim 5 which the curved front wall of the base includes a raised flat panel displaced a short distance forward of the front wall and identical sets of vertical panels connecting the raised flat panel to the front wall of the base.

7. The device according to claim 6 in which the flat panel of the base includes a curved top edge following the curve of the oval aperture in the front panel of the cover.

8. The device according to claim 1 in which the cover does not have a back wall and further including means on the back wall of the base for mounting the base to a flat, vertical wall.

9. The device according to claim 8 in which the mounting means comprises a hook member extending from said back wall having a distal hook end for sliding attachment to the top of a toilet tank.

10. The device according to claim 8 wherein said mounting means comprises at least one aperture through said back wall and a fastener partially disposed through each aperture for fastening the base to said vertical wall.

11. The device according to claim 8 wherein said mounting means comprises an adhesive strip disposed on a portion of said back wall.

* * * * *